United States Patent [19]

Fink

[11] 4,023,496

[45] * May 17, 1977

[54] EJECTOR MOTOR BRAKING SYSTEM

[75] Inventor: Robert H. Fink, Huntsville, Ala.

[73] Assignee: The United States of America as represented by the Secretary of the Army, Washington, D.C.

[ * ] Notice: The portion of the term of this patent subsequent to Sept. 17, 1992, has been disclaimed.

[22] Filed: Aug. 9, 1972

[21] Appl. No.: 279,143

[52] U.S. Cl. ..... 102/49.4; 89/1.818

[51] Int. Cl.[2] ..... F42B 15/10

[58] Field of Search ..... 102/49.4, 49.5; 244/3.28; 89/1.818, 1.8, 1 F

[56] References Cited

UNITED STATES PATENTS

| | | | |
|---|---|---|---|
| 2,821,924 | 2/1958 | Hansen et al. | 244/3.28 |
| 2,940,391 | 6/1960 | Brandt | 244/3.28 X |
| 3,216,357 | 11/1965 | Mertens | 102/49.5 X |
| 3,308,759 | 3/1967 | Sorenson | 102/49.4 |
| 3,380,382 | 4/1968 | Jablansky | 244/3.28 X |
| 3,457,861 | 7/1969 | Crockett | 102/49.4 |
| 3,491,689 | 1/1970 | Francois | 102/49.4 X |

*Primary Examiner*—Harold Tudor

*Attorney, Agent, or Firm*—Nathan Edelberg; Robert P. Gibson; James T. Deaton

[57] ABSTRACT

A two stage separable missile adapted to be expelled from a launch tube by a separable ejector motor and propelled along its trajectory by a flight motor ignited after the missile leaves the launch tube. The first stage includes a warhead, flight rocket motor and foldable tail fins. The second stage mounts on the rear of the first stage and encloses the folded tail fins. The second stage includes an ejector rocket motor for ejecting the missile from its tube and a braking motor for separating the first and second stages and decelerating the second stage to a zero velocity by the time it has traveled the length of the launch tube.

5 Claims, 3 Drawing Figures

EJECTOR MOTOR BRAKING SYSTEM

BACKGROUND OF THE INVENTION

This invention relates to missiles intended to be fired from an aircraft or from a shoulder supported launcher. More particularly the invention relates to missiles wherein a separable ejector motor is employed to expel the missile from the launch tube prior to ignition of the flight motor.

The requirements for tube launched missiles have reached the point where it is not possible to achieve desired velocities without separable stages. The stage that ejects the missile from the launch tube, the ejector motor, burns only briefly after ignition thereof and then it falls to the ground. It can be readily appreciated that such a falling mass can be a hazard to friendly troops in the area where the missile is fired, wheither fired from the ground or from an aircraft. Heretofore when missiles having separable stages were employed it was necessary to use some type of releasable latch mechanism to secure the stages that could, as desired, be released to allow separation of the stages. A common practice being to release the stages and then rely on acceleration and drag forces that occur when the main flight motor is fired to separate the stages.

SUMMARY OF THE INVENTION

A principal object of the present invention is to provide a multistage separable missile of the type discussed above having an ejector stage that includes a braking motor for decelerating the entire ejector stage substantially to zero by the time it reaches the discharge or muzzle end of its launch tube.

Another important object is to provide a separable missile with a braking motor that in addition to decelerating the ejector stage of the missile also functions to separate the ejector stage from the remainder of the missile.

The above objectives are accomplished by providing a two stage separable missile wherein an ejector stage functions to eject a flight stage from a launch tube. The flight stage includes a warhead, a flight rocket motor and tail fins pivotally mounted on the rear of the flight stage. The tail fins are foldable to a stowed position where they can be contained in the forward end of the ejector stage. The ejector stage includes an open ended, cylindrical end section that slides over the folded tail fins and on to one end of the flight stage. An ejector motor that exhausts in a direction to accelerate both stages of the missile in a direction out of the launcher is mounted in the aft end of the ejector stage. A braking motor mounted in the ejector stage is ignited after the ejector motor and arranged to exhaust in a direction opposite to that of the ejector motor so as to decelerate the ejector stage and separate the two stages. Preferably the ejector stage is decelerated to a point where it remains in the launch tube.

DETAILED DESCRIPTION OF THE INVENTION

Figure 1:
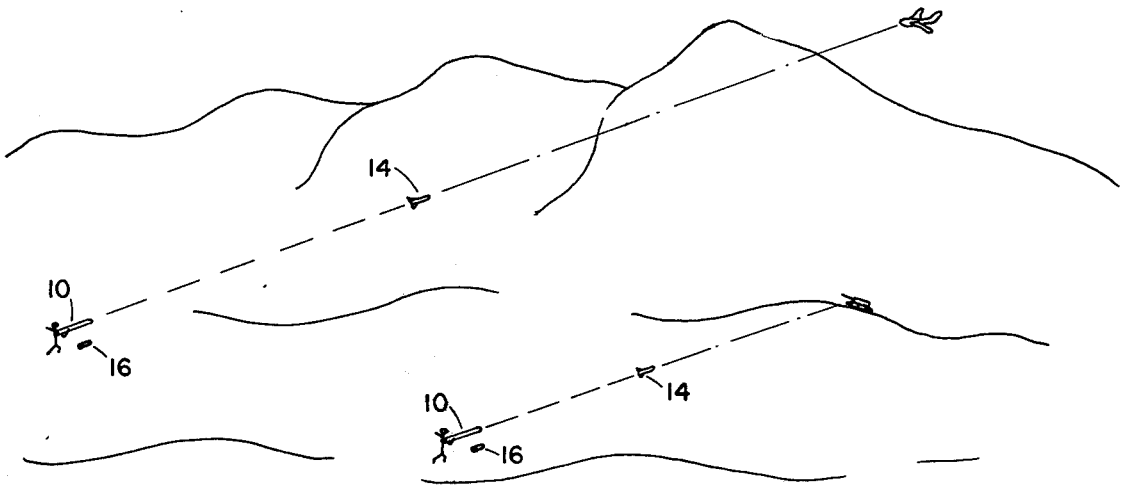
FIG. 1 is a pictorial illustration of how the missile could be deployed against targets such as a tank or aircraft.

In FIG. 1 the invention is shown deployed in a situation where a missile is fired from a shoulder supported launcher 10 at typical targets such as an aircraft or tank. The missile is a type that can be termed a boost-coast-boost missile. By this it is meant that the missile is first accelerated from the launch tube by a first ejector rocket motor whose burn is completed within the launch tube so that launcher personnel firing the launcher are not endangered by the rocket motor exhaust. The missile then coasts for a desired distance from the muzzle of the launcher and a flight rocket motor is ignited to propel the missile to an intercept with its target.

The velocity requirements of tube launched missiles are rapidly becoming such that it will not be possible to achieve desired velocities without separable stages, that is using a separable ejector motor to eject the flight missile from the launcher so as to achieve higher launch velocities. Higher velocities are needed in order that higher speed targets may be engaged without an undue increase in missile weight. The ejector stage after being separated falls to the ground and presents a falling hazard to friendly troops in the area. These motors even though generally small; on the order of, for example, 3 inches by 4 inches and one pound in weight, require a safety zone in front of the launcher of approximately 15° and up to 600 yards in length.

Figure 2:
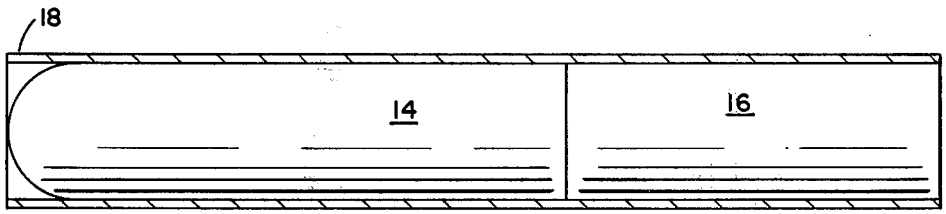
FIG. 2 is a view of the assembled missile positioned in a launch tube.

As shown in FIGS. 1 and 2 the missile includes a flight stage 14 and an ejector stage 16. In FIG. 1 a spent ejector stage 16 is shown laying on the ground forward of the launcher from which it came. However, it should be understood the ejector stage could just as well be decelerated to an extent where it remains in the launch tube. This would be a particularly desirable feature if the missile were being fired from an aircraft operating in close proximity to friendly personnel or from a launch tube of a type that is employed as a shipping and carrying container for the missile and used only once or at least to reloaded in the field. FIG. 2 illustrates the missile positioned in a launch tube 18.

Figure 3:
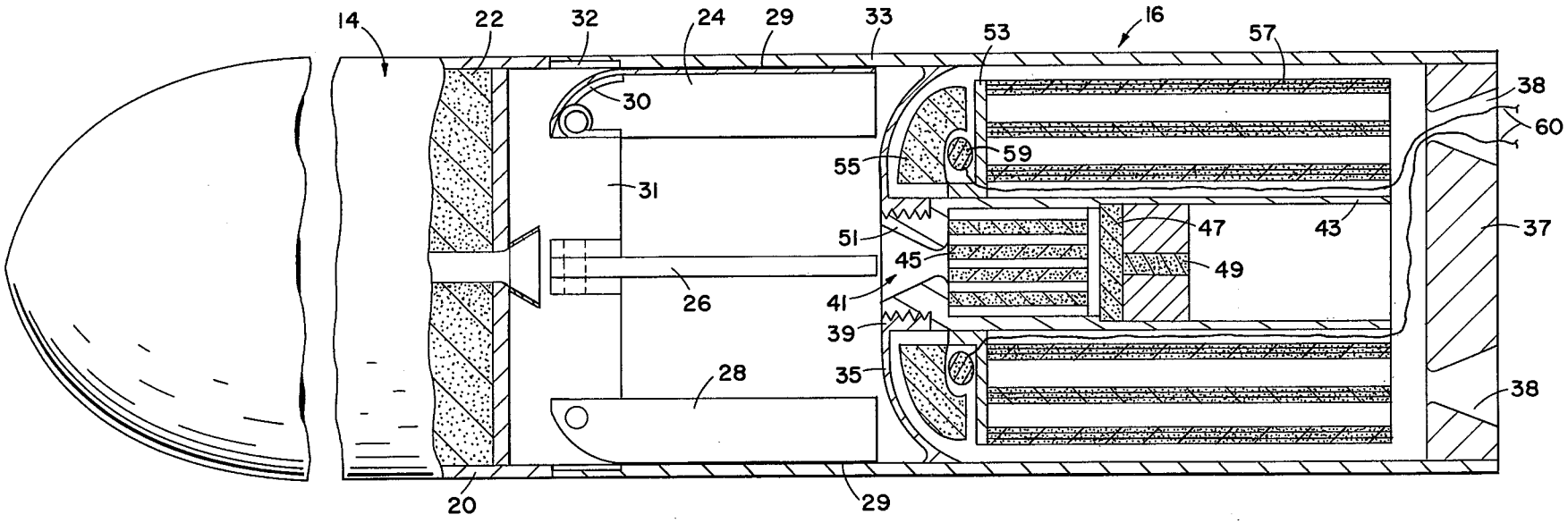
FIG. 3 is a view of the missile, cross sectioned in part and broken away in parts, illustrating the internal details of the ejector and braking motor.

Referring now to FIG. 3 where the missile is illustrated in detail. The missile includes a flight stage 14 composed of an outer casing 20 that encloses a warhead (not shown) of a suitable type and a rocket motor 22. A plurality of pop up tail fins 24, 26 and 28 are mounted on the aft end of casing 20. The tail fins are biased to a deployed position by a suitable means such as spring 30 upon separation of the two stages. The construction of the tail fins and the deployment thereof is conventional except for a fricton free coating 29 applied to portions of the tail fins and therefore a description in minute detail is not necessary. A skirt like section 31 extends rearwardly from casing 20 for mounting the ejector stage. Skirt 31 has slots 32 tht allow the tail fins to deploy.

Ejector stage 16 includes a housing 33 open at the forward end for sliding over the tail fins and skirt 31. Those surfaces of the tail fins that contact casing 33 are provided with a thin coating 29 of teflon or other suitable coating to reduce friction. A dome like member 35 is mounted intermediate the ends of casing 33 and a base member 37 is mounted in the rearward end of casing 33 to form a motor casing for the ejector motor mounted in the rear of housing 33. Base member 37 has exhaust nozzles 38 formed therein. Member 35 has an internally threaded section 39 in which a braking motor 41 is mounted. The braking motor includes a housing 43 that contains a scroll type propellant grain 45, an igniter grain 47 for igniting the propellant and a powder delay train 49. Housing 43 has a nozzle section 51 on one end thereof that forms a convergent divergent exhaust nozzle that is threaded into threaded section 39. A radially extending flange member 53 is mounted on housing 43 in a position such that it is near dome-like member 35 when the round is assembled. The ejector motor includes igniter charge 55 mounted on the forward side of the flange member and a scroll type propellant charge 57 mounted aft of the flange. Igniter 55 is electrically ignited by a suitable electric squibb means 59 having wires 60 running outside of the missile.

The operation of the missile is as follows, assuming that the missile is assembled together and positioned in a launch tube ready for launch. The operator or gunner would fire the missile, that is activate squibb 59 which ignites ignition charge 55 which in turn ignites propellant grain 57 of the ejector motor. The gases generated by the burning of propellant grain 57 are expanded through nozzles 38 to generate thrust for ejecting the missile. These gases also ignite powder delay train 49. The powder delay train is chosen with a suitable delay so that by the time the ejector motor has substantially completed its burn the braking motor is ignited and its exhaust is discharged through nozzle 51 to decelerate the ejector stage substantially to zero velocity by the time it reaches the discharge end of the launch tube. The reverse thrust generated by the braking motor also functions to separate the flight stage from the ejector stage. Separation is facilitated by the teflon coating applied to the fins.

The flight stage leaves the launcher and coasts for a desired distance before the flight stage rocket motor 22 is ignited by a suitable igniter (not shown) to begin the final boost phase of the missile's trajectory. As soon as the missile leaves the launch tube the tail fins deploy.

This completes the detailed description of the invention. While a preferred embodiment has been disclosed there will be many obvious modifications apparent to one skilled in the art; for example, time delays other than a powder train can be used with the ejector motor and various types of igniter devices could be employed with any suitable rocket motor.

What is claimed is:

1. In a tube launched missile system having a two stage separable missile to be launched from a rocket launcher tube that is open at each end, the improvement comprising:

a first stage that includes a first casing having a rocket motor mounted therein and foldable fin means mounted on the rearward end thereof, a second stage that includes a second casing having its forward end slidably mounted on the rearward end of said first casing, an ejector motor means mounted in said second casing and arranged to exhaust from the rearward end of said second casing so as to eject said missile from the launcher tube, a braking motor means mounted in said second casing and arranged to exhaust from the forward end of said second casing for separating said first and second stages and decelerating said second stage substantially to zero by the time said second stage reaches the muzzle end of the launcher tube, thus reducing the risks of injury to the surroundingsby the second stage.

2. The tube launched missile system recited in claim 1 wherein:

said foldable fin means includes a plurality of tail fins that are normally spring biased to an open position unless restrained in a folded position, and said second casing includes a forward end section that slides over the folded tail fins with a friction fit and abutts the rearward end of said first casing.

3. The tube launched missile system recited in claim 2 wherein those areas of each of said tail fins tht contact said second casing are provided with a relatively friction free coating to facilitate separation of said first and second stages of said missile.

4. The tube launched missile system recited in claim 3 wherein, said ejector motor means comprises a cylindrical propellant grain having a central cavity and said braking motor means is mounted in said cavity in a position whereby said braking motor is ignited by the exhaust from said ejector motor.

5. The tube launched missile system recited in claim 4 which further includes:

a base member mounted in the rearward end of said second casing for substantially closing the rearward end thereof, said base member having at least one nozzle opening formed therein for exhausting said ejector motor, a dome-like member mounted intermediate the ends of said second casing, said dome-like member including a rearwardly extending, centrally disposed and internally threaded section, said dome-like member and said base member along with said second casing forming a motor casing for said ejector motor, and said braking motor includes a motor casing having a nozzle section on one end thereof, said nozzle section being externally threaded so as to mount in the internally threaded section of said dome-like member, whereby said ejector motor exhausts from the rear of said second stage and said braking motor exhausts toward the forward end of said second stage.

* * * * *

UNITED STATES PATENT OFFICE

CERTIFICATE OF CORRECTION

PATENT NO. : 4,023,496

DATED : May 17, 1977

INVENTOR(S) : Robert H. Fink

It is certified that error appears in the above-identified patent and that said Letters Patent are hereby corrected as shown below:

Column 2, line 41, "to" should read --not--; column 2, line 56, "tht" should read --that--; column 4, line 14, "surroundingsby" should read --surroundings by--; and column 4, line 25, "tht" should read --that--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*